US005154427A

United States Patent [19]

Harlan et al.

[11] Patent Number: 5,154,427

[45] Date of Patent: * Oct. 13, 1992

[54] GOLFER'S SWING ANALYSIS DEVICE

[76] Inventors: Thomas A. Harlan, 15401 Rock Creek, Austin, Tex. 78734; Joseph F. Long, 1335 Lost Creek Blvd., Austin, Tex. 78746

[ * ] Notice: The portion of the term of this patent subsequent to Nov. 26, 2008 has been disclaimed.

[21] Appl. No.: 722,180

[22] Filed: Jun. 27, 1991

Related U.S. Application Data

[63] Continuation-in-part of Ser. No. 611,683, Nov. 7, 1990, Pat. No. 5,067,717.

[51] Int. Cl.[5] ..... A63B 69/36

[52] U.S. Cl. ..... 273/186.3; 273/187 R

[58] Field of Search ..... 273/183 B, 186 A, 186 R, 273/187 R

[56] References Cited

U.S. PATENT DOCUMENTS 5,067,717 11/1991 Harlan et al. ..... 273/183 B

*Primary Examiner*—George J. Marlo

*Attorney, Agent, or Firm*—Joseph F. Long

[57] ABSTRACT

This repeatable golf swing teaching device tracks real time movement of a golf club head during a swing using a light gun attached to or inside the club head interacting with light sensors on a base and an upright panels to indicate path of movement. When a desired swing path is achieved the paths may be locked in a computer and the desired swing path thereafter compared with subsequent swings with an alarm activated as a subsequent swing deviates from the desired swing path.

5 Claims, 2 Drawing Sheets

GOLFER'S SWING ANALYSIS DEVICE

This is a continuation-in-part of my patent, Ser. No. 07/611,683, filed Nov. 7, 1990, entitled: A Repeatable Golf Swing Teaching Device, now U.S. Pat. No. 5,067,717.

BACKGROUND

Golf is a sport that has existed for more than a half of century in almost its present form. It is, however, still one of the faster growing sports, possibly because of all the varied possibilities for exercise, socializing, conducting business, etc. At any rate, a great many players are willing to pay a golf pro to teach them how to improve their game. From study of many players actual in-play motion the professional trainers would agree that substantial practice is necessary to achieve a repeatable swing. Further, the pros have amply demonstrated that positioning the body, positioning the hands, shifting weight and many other interrelated factors may affect just how and where the ball travels after club impact.

The device of this invention is aimed at determining reproducibility of the path of the club upon backswing and downswing to impact the ball and reproducibility of body placement and weight shift. These are accomplished by determining path of movement of the club during a swing and positioning of the feet and shifting of weight during the swing using pressure sensitive pads and a light in the clubhead striking photo sensitive detectors or light sensors. Light emitted from the clubhead impacts light sensors that communicate with a computer and also directly light display lights adjacent to the sensors. When a golf student, with the aid of a pro, achieves a swing that appears right for him, the computer may be set to lock in the swing paths as a pre-chosen path. On the subsequent swings, the computer, which is an integral part of the device, may activate an alarm such as a flashing red light when the swing deviates too much from the pre-chosen paths. This real time swing comparison causes the golfer to interrupt a non-standard or not pre-chosen swing to reinforce his learning of only a standard swing. Note the pre-chosen path would be a standard swing for the individual golfer.

A pressure sensitive pad with multiple sensors and with indicator lights allows the golf student to lock in the computer the chosen foot location. With this unit, the computer may also indicate weight shift. The implicit assumption here is that interrupting or signaling a non-standard swing prevents reinforcing of bad swing habits. Computer analysis of the weight shift, foot placement and clubhead path allow computer "instruction" of the individual golfer.

We have examined the following patents:

| U.S. Pat. No. | Date | Inventor |
|---|---|---|
| 4,304,406 | 12/8/81 | J. I. Cromarty |
| 4,254,956 | 3/10/81 | T. L. Rosnak |
| 3,601,408 | 8/24/71 | U. K. Wright |
| 4,327,918 | 4/4/82 | D. B. Foster |
| 4,137,566 | 1/30/79 | S. L. Haas et al |
| 4,858,934 | 8/22/89 | R. B. Ladick et al |
| 4,451,043 | 5/29/84 | Koji Ogawa et al |

All of these patents are intended to improve a players golf swing but use a different approach than our present device.

SUMMARY OF THE INVENTION

Using a first battery powered light gun attached inside the golf club with flexible fiber optic cables leading to and emitting light from the club head and a base and upright panels containing light sensors and display lights communicating with a properly programmed computer a light path formed by light emitting from the club head may be stored and recalled from a computer. When a desired swing is achieved this swing path or light path is saved and thereafter illuminated as a prechosen path for a particular golfer. The computer may be programmed to activate an alarm or halt light (which may simply be a flashing red light) when subsequent swings produce a light path deviating from the prechosen path.

A pressure sensitive pad with multiple sensors communicating with a computer allows the user to determine proper foot location and weight shift and lock it in the computer so that on subsequent usage the proper foot location may be indicated in some manner, such as a green light.

With inputs from pressure sensors and light sensors, the computer may analyze each swing subsequent to locking in prechosen swing and proper foot location. For example speed of backswing and relative time of shifting of weight could be indicated as a print-out even if each swing were within allowable limit of pre-chosen swing.

DETAILED DESCRIPTION OF THE INVENTION

Figure 1:
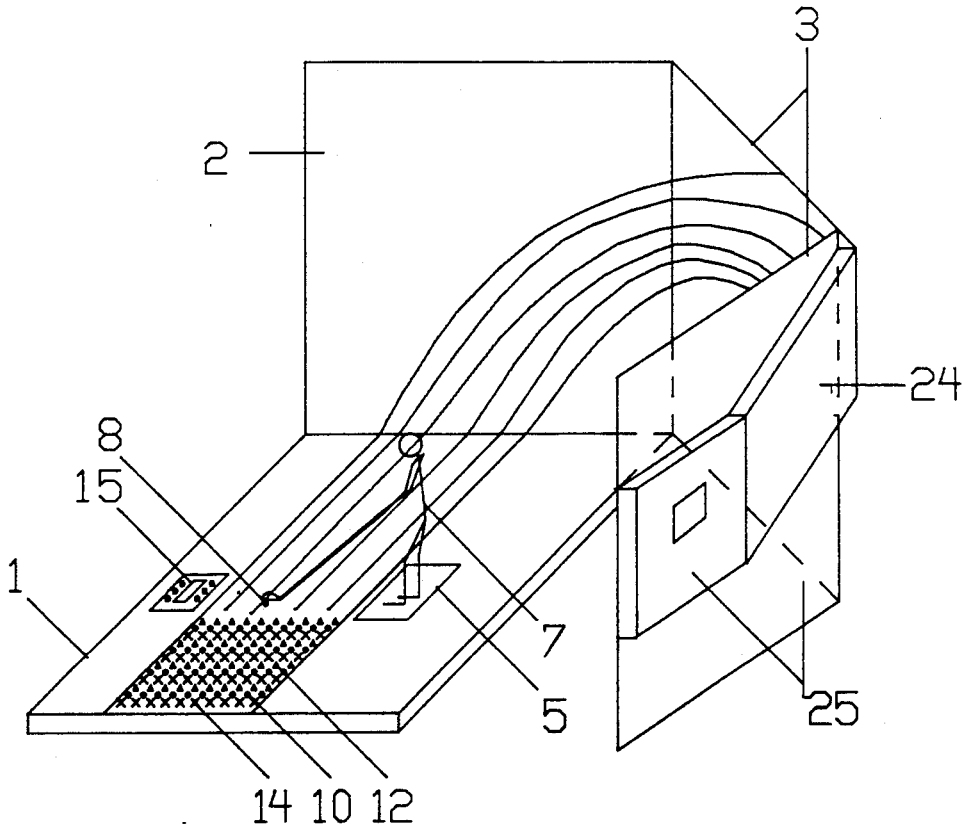
FIG. 1 shows a three dimensional view of the equipment and location of student golfer during equipment use.

The preferred embodiment of this invention may best be described from the drawings. Consider first FIG. 1, base panel 1 is hinged at one end to side panel 2 which is hinged on one side to back panel 3. Back panel 3 could be a single panel but a two segment hinged panel is preferred. With proper sizing, these panels may be folded together for easy transportation.

In use golfer 7 stands on pressure sensitive pad 5. Multiple sensors in this pad communicate through a wiring channel 24, which is on the back of each panel, to computer 25. Then a desired foot placement is determined and this location is set in the computer 25 and the computer activates a green light 16, FIG. 2 on instruction panel 15. For later analysis, the weight pattern for each foot is saved in the computer and the program is such that weight shift timing may be compared to timing and light path during the swing to indicate proper club head location for the weight shift to occur. This may lead to computer print-out such as "Weight Shift is O.K."

Figure 3:
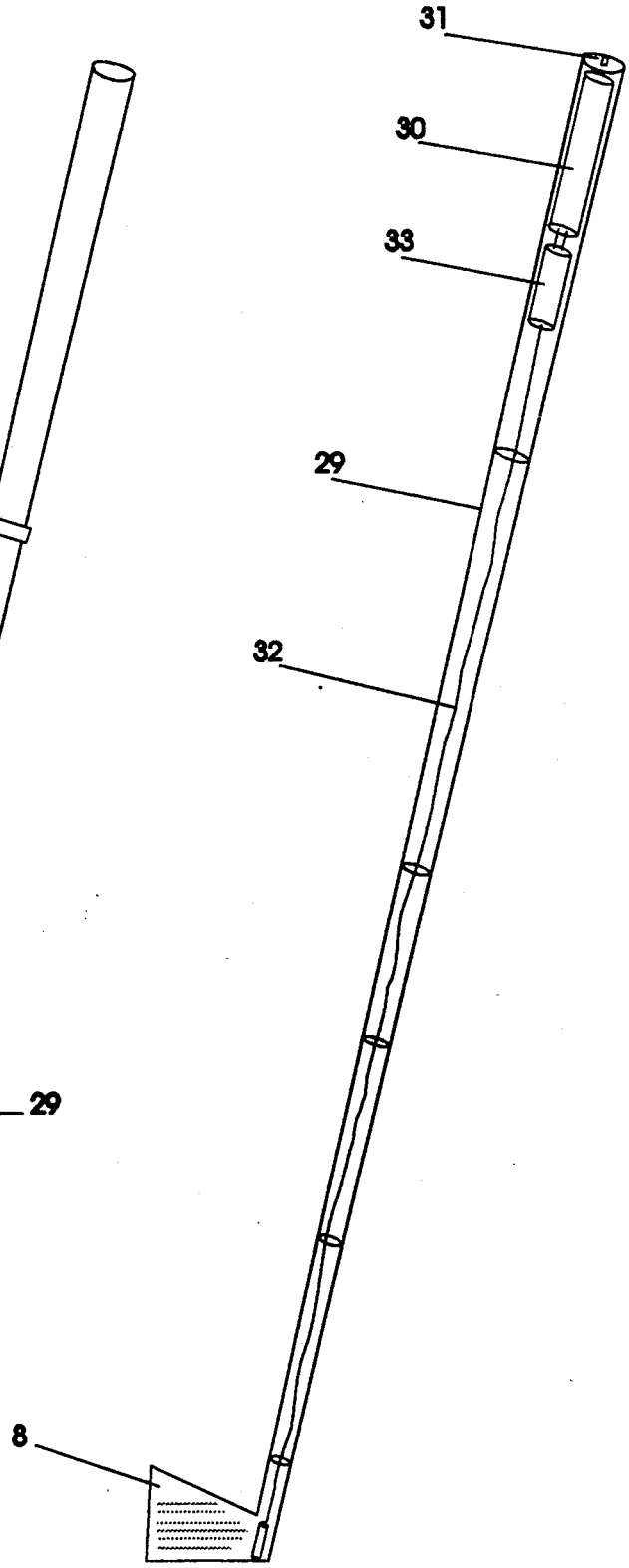
FIG. 3 indicates placement of a switch, battery, light and light conducting fibers inside a golf club in a first embodiment.

In use as golfer 7 moves club head 8 the light path from light gun 33, FIG. 3, indicating club head movement will contact sensors 10 and red lights 14 and/or green lights 12 shown in detail in front of club head 8 and extending along paths indicated by lines in the drawing will light up according to program in computer 25. Normally after the standard a pre-chosen path is locked in the computer green lights 12 are activated to show proper path and red lights 14 come on with an out-of-standard path swing. An audible alarm 23 included in instruction panel 15 may also be used.

Figure 2:
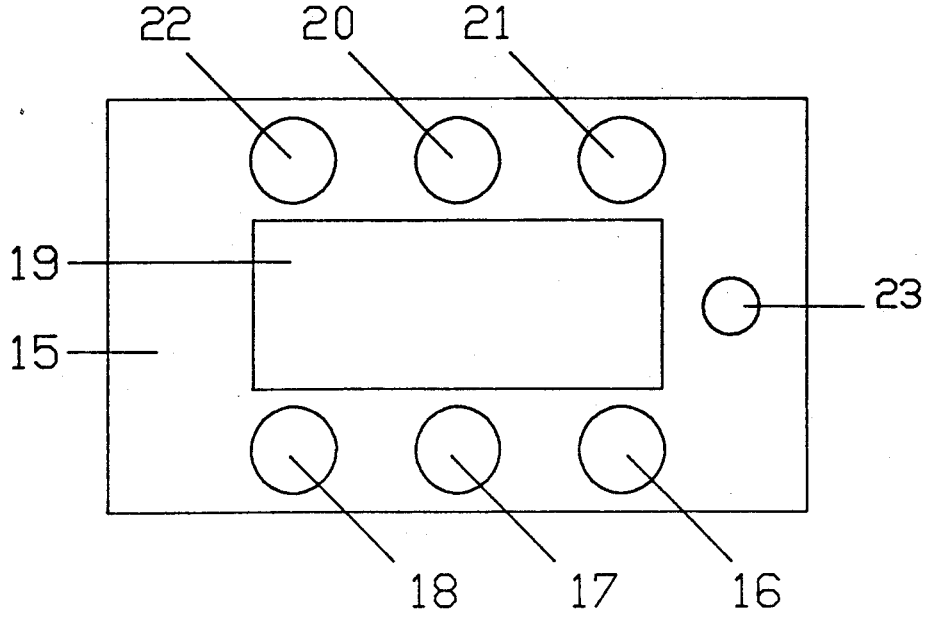
FIG. 2 shows more detail of the golfer instruction panel.

FIG. 2 shows golfer instruction panel 15 in more detail. Green light 16 indicates proper foot placement. Light 18 changes from green to red if backswing speed is out of standard and similarly light 20 changes from green to red if downswing speed is out of standard while halt light 21 flashes red if backswing path is out of standard or pre-chosen path. Downswing halt light 22 also flashes red when out of standard or out of a pre-chosen path occurs. Standard or pre-chosen paths are determined as "correct" for each individual golfer, usually with the aid of an instructor. Pre-chosen or standard 7 are locked in the computer and allowable variations are built in the computer golf training program. Read out 19 prints out brief analysis on command after each swing. Analysis relates weight shift and swing light path and swing speed.

In FIG. 3 we show a first embodiment with a manually operable switch 31, a battery 30, and a light gun 33 held in place inside a golf club with light conducting means leading from the light gun to emit light from the bottom face of the club head 8. The light may be a laser light or normal incandescent light. Similarly, wires from a battery to a light emitting diode would be within the scope of this invention.

Figure 4:
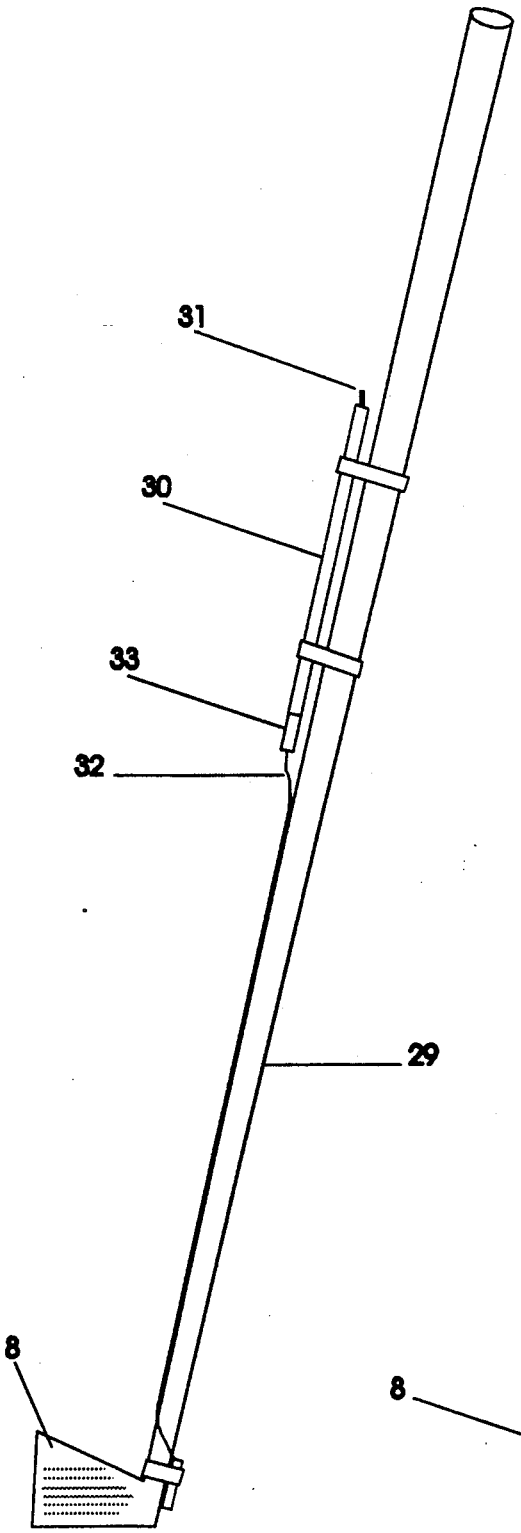
FIG. 4 indicates placement of a switch, battery, light, and light conducting cables to allow retrofitting existing golf clubs.

In FIG. 4 we show a second embodiment wherein manual switch 31, battery 30, light gun 33, and fiber optic cable 32 are external to the club 29. This embodiment would be useable for retrofitting existing golf clubs.

Legend

FIG. 1

1=base panel
2=side panel
3=back panel
5=pressure sensitive panel pad with multiple sensors
7=golfer
8=ball on tee
10=light sensors
12=red display lights
14=green display lights
15=golfer instruction panel
24=wiring channel
25=computer

FIG. 2

15=golfer instruction panel
16=foot placement
8=backswing speed
19=readout
20=downswing speed
21=backswing path halt light
22=downswing path halt light
23=audible alarm

FIG. 3

8=club head
29=golf club
30=battery in golf club
31=light switch
32=fiber optic cable
33=light

FIG. 4

8=club head
29=golf club
30=battery in golf club
31=light switch
32=fiber optic cable
33=light

What is claimed is:

1. A repeatable golf swing teaching device comprising:

a) a base platform, a vertical side panel, and vertical back panel;

b) a pressure sensitive pad containing multiple pressure sensors on said base platform;

c) multiple light sensor means and multiple green and multiple red display lights in a range of swing paths in said base platform, said vertical panel and said back panel;

d) a manually operable switch, a battery, a battery powered light gun and fiber optic cable fitted inside a golf club with said fiber optic cable terminating in a lower plane of a head of said golf club;

e) a computer communicating with said multiple pressure sensor means and said multiple light sensor means and said multiple display lights in said base platform, said vertical side panel and said vertical back panel; said computer acting to:

1) light a red light in said pressure sensitive pad if signals received from said multiple pressure sensors differ from a previously chosen pattern;

2) light a portion of said multiple red display lights indicating light path of incident light from said fiber optic cable in said head of said golf club as said golf club is swung at a ball;

3) record wing path of each swing and to activate an alarm if said swing path differs markedly from a pre-chosen swing path;

4) to activate a portion of said multiple green display lights to form said pre-chosen swing paths when a save and permanent display command is entered.

2. A repeatable golf swing teaching device as in claim 1 further comprising a computer output indicating elapsed time from start of a backswing to impact on a golf ball.

3. A repeatable golf swing teaching device as in claim 1 further comprising computer output of analysis of each golf swing as compared to said pre-chosen swing.

4. A repeatable golf swing teaching device as in claim 1 further comprising computer output indicating deviation from a standard of weight shift of said golf student during a swing.

5. A repeatable golf swing teaching device comprising:

a) a base platform, a vertical side panel and vertical back panel;

b) a pressure sensitive pad containing multiple pressure sensors on said base platform;

c) multiple light sensor means and multiple green and multiple red display lights in a range of swing paths in said base platform, said vertical panel and said back panel;

d) a manually operable switch, a battery, a battery powered light gun and fiber optic cable with means to securely fasten said switch, said battery, said light gun and said fiber optic cable to a golf club; said fiber optic cable terminating to point directly downward parallel to a shaft of said golf club;

e) a computer communicating with said multiple light sensor means and said multiple pressure sensors and said multiple display lights in said base platform, said vertical side panel and said vertical back panel; said computer acting to:

1) light a red light in said pressure sensitive pad if signals received from said multiple pressure sensors differ from a previously chosen pattern;

(2) light a portion of said multiple red display lights indicating light path of incident light from said fiber optic cable on said shaft as said golf;

3) record swing path of each swing and to activate an alarm if said swing path differs markedly from a pre-chosen swing path;

4) to activate a portion of said multiple green display lights to form said pre-chosen swing path when a save and permanent display command is entered.

* * * * *